US010483024B2

(12) United States Patent
Jeong

(10) Patent No.: US 10,483,024 B2
(45) Date of Patent: Nov. 19, 2019

(54) COIL ELECTRONIC COMPONENT

(71) Applicant: SAMSUNG ELECTRO-MECHANICS CO., LTD., Suwon-si, Gyeonggi-do (KR)

(72) Inventor: Dong Jin Jeong, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 722 days.

(21) Appl. No.: 15/088,707

(22) Filed: Apr. 1, 2016

(65) Prior Publication Data

US 2016/0351313 A1 Dec. 1, 2016

(30) Foreign Application Priority Data

May 29, 2015 (KR) ..... 10-2015-0075949

(51) Int. Cl.

| | |
|---|---|
| ***H01F 3/10*** | (2006.01) |
| ***H01F 17/00*** | (2006.01) |
| ***H01F 17/04*** | (2006.01) |
| *H01F 27/29* | (2006.01) |

(52) U.S. Cl.

CPC ..... *H01F 3/10* (2013.01); *H01F 17/0013* (2013.01); *H01F 17/04* (2013.01); *H01F 27/292* (2013.01); *H01F 2003/106* (2013.01); *H01F 2017/048* (2013.01)

(58) Field of Classification Search

CPC ..... H01F 2017/008; H01F 3/10

See application file for complete search history.

(56) References Cited

U.S. PATENT DOCUMENTS

| | | | | |
|---|---|---|---|---|
| 6,324,430 | B1 * | 11/2001 | Zarinetchi | A61N 1/3787 607/61 |
| 2010/0182116 | A1 * | 7/2010 | Ishimoto | H01F 17/0006 336/192 |
| 2013/0082813 | A1 * | 4/2013 | Wi | H01F 5/003 336/200 |
| 2013/0154767 | A1 * | 6/2013 | Kim | H01F 17/0013 333/185 |
| 2013/0249662 | A1 * | 9/2013 | Tonoyama | H01F 27/255 336/200 |

(Continued)

FOREIGN PATENT DOCUMENTS

| | | |
|---|---|---|
| CN | 1279819 A | 1/2001 |
| CN | 102598168 A | 7/2012 |

(Continued)

OTHER PUBLICATIONS

Chinese Office Action issued in Application No. 201610139955.4 dated Jul. 26, 2014, with English translation.

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil electronic component including: a substrate; a coil pattern disposed on at least one surface of the substrate; a body filling at least a core area of the coil pattern and containing a magnetic material; and a magnetic flux controller disposed at an outer surface of the body to correspond to the core area and containing a magnetic material which has a permittivity value higher than that of the magnetic material of the body.

20 Claims, 2 Drawing Sheets

(56) References Cited

U.S. PATENT DOCUMENTS

| | | | | |
|---|---|---|---|---|
| 2014/0022042 | A1* | 1/2014 | Park | H01F 17/0013 336/200 |
| 2015/0123757 | A1 | 5/2015 | Choi | |
| 2015/0141784 | A1* | 5/2015 | Morun | G06F 3/015 600/372 |
| 2016/0178537 | A1* | 6/2016 | Leek | G01V 3/38 324/637 |
| 2016/0352016 | A1* | 12/2016 | Ito | H01Q 7/00 |
| 2018/0026177 | A1* | 1/2018 | Sun | G11C 11/22 365/158 |
| 2018/0033530 | A1* | 2/2018 | Ueyama | C08K 3/08 |

FOREIGN PATENT DOCUMENTS

| | | | | | |
|---|---|---|---|---|---|
| CN | 204270777 | U | | 4/2015 | |
| JP | H06-196332 | A | | 7/1994 | |
| JP | H06196332 | A | * | 7/1994 | H01F 17/00 |
| JP | 2013045848 | A | * | 3/2013 | |
| JP | 2013-201374 | A | | 10/2013 | |
| WO | 99/16093 | A1 | | 4/1999 | |
| WO | 2011/031473 | A2 | | 3/2011 | |

* cited by examiner

COIL ELECTRONIC COMPONENT

CROSS-REFERENCE TO RELATED APPLICATION

This application claims the benefit of priority to Korean Patent Application No. 10-2015-0075949 filed on May 29, 2015, with the Korean Intellectual Property Office, the disclosure of which is incorporated herein by reference.

TECHNICAL FIELD

The present disclosure relates to a coil electronic component.

BACKGROUND

An inductor, which is a coil electronic component, is a representative passive element configuring an electronic circuit together with a resistor and a capacitor, or the like, for removing noise from the electronic circuit or forming an LC resonance circuit.

Recently, as products in which electronic components are used are becoming complex and multi-functional, a demand for compact, large-current, and high-capacity coil electronic components for use in such products has increased. Therefore, conventional inductors have rapidly been replaced by small, high-density chips which may be automatically surface-mounted, and thin film-type inductors have been developed by mixing a magnetic powder with a resin and forming coil patterns on upper and lower surfaces of a thin film insulating substrate by plating.

However, the thin film-type inductors may have a considerable amount of magnetic flux leakage when the amount of current flowing in the products containing electronic components increases, which leads to malfunction of such products. To address this problem, research into suppressing the leakage of magnetic flux from the thin film-type inductors has been continuously conducted.

SUMMARY

An aspect of the present inventive concept provides a coil electronic component capable of considerably reducing the amount of external leakage of magnetic flux.

According to an exemplary embodiment in the present disclosure, a coil electronic component may include: a substrate; a coil pattern disposed on at least one surface of the substrate; a body filling at least a core area of the coil pattern and containing a magnetic material; and a magnetic flux controller disposed at an outer surface of the body to correspond to the core area and containing a magnetic material having a permittivity value higher than that of the magnetic material of the body.

The permittivity value of the magnetic material included in the magnetic flux controller may be equal to or greater than 30 F/m.

The permittivity value of the magnetic material included in the magnetic flux controller may be 1.5 times greater or more than that of the magnetic material included in the body.

When a thickness of the magnetic flux controller is $T_1$ and a minimum distance from the outer surface of the body, at which the magnetic flux controller is disposed, to a top surface of the coil pattern in a thickness direction of the coil electronic component is $T_2$, a ratio ($T_1/T_2$) of $T_1$ to $T_2$ may be equal to or less than ⅓.

When viewing the coil electronic component from a side in a thickness-length direction thereof, a length of the magnetic flux controller may be shorter than that of the core area.

The magnetic flux controller may extend in a width direction of the coil electronic component from a center toward both sides of the body.

When viewing the coil electronic component in a width-length direction thereof, a length of the magnetic flux controller may be shorter than that of the core area.

The magnetic flux controller may extend in a length direction of the coil electronic component from a center toward both sides of the body.

When viewing the coil electronic component in the width-length direction thereof, a length of the magnetic flux controller may be longer than that of the core area.

The coil electronic component may further include: external electrodes attached to side outer surfaces of the body and electrically connected to the coil pattern.

The coil pattern may be formed in plural on both surfaces of the substrate, and the plural coil patterns may be connected to each other.

The magnetic material may be dispersed in a particle form in a thermosetting resin.

According to another exemplary embodiment in the present disclosure, a coil electronic component may include: a substrate; at least one coil pattern disposed on upper and lower surfaces of the substrate; a body filling at least a core area of the coil pattern and containing a magnetic material; a body filling a core area of the coil pattern and having a first magnetic material, the core area being in a center of the body; external electrodes attached to side surfaces of the body and electrically connected to the coil patterns; and a second magnetic material grooved into the body at a center area of an outer surface of the body to correspond to the core area and having a second magnetic material which has a permittivity value higher than that of the first magnetic material.

BRIEF DESCRIPTION OF THE DRAWINGS

The above and other aspects, features and other advantages of the present disclosure will be more clearly understood from the following detailed description taken in conjunction with the accompanying drawings.

DETAILED DESCRIPTION

Figure 1:
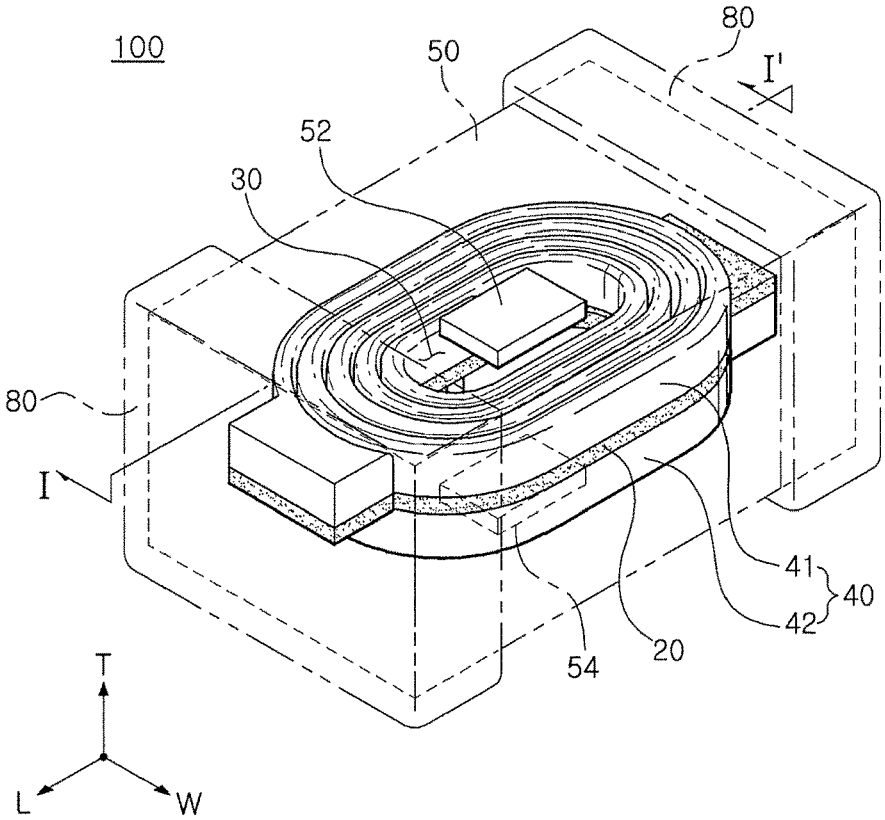
FIG. 1 is a perspective view schematically illustrating a coil electronic component according to an exemplary embodiment in the present disclosure in which a substrate and coil patterns are visible.

Hereinafter, embodiments of the present inventive concept will be described as follows with reference to the attached drawings.

The present inventive concept may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present inventive concept. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present inventive concept will be described with reference to schematic views illustrating embodiments of the present inventive concept. In the drawings, for example, due to manufacturing techniques and/or tolerances, modifications of the shape shown may be estimated. Thus, embodiments of the present inventive concept should not be construed as being limited to the particular shapes of regions shown herein, for example, to include a change in shape results in manufacturing. The following embodiments may also be constituted by one or a combination thereof.

The contents of the present inventive concept described below may have a variety of configurations and propose only a required configuration herein, but are not limited thereto.

Hereinafter, a coil electronic component according to an exemplary embodiment in the present disclosure, particularly, a thin film-type inductor will be described as an example. However, the coil electronic component according to the exemplary embodiment in the present disclosure is not necessarily limited thereto.

Figure 2:
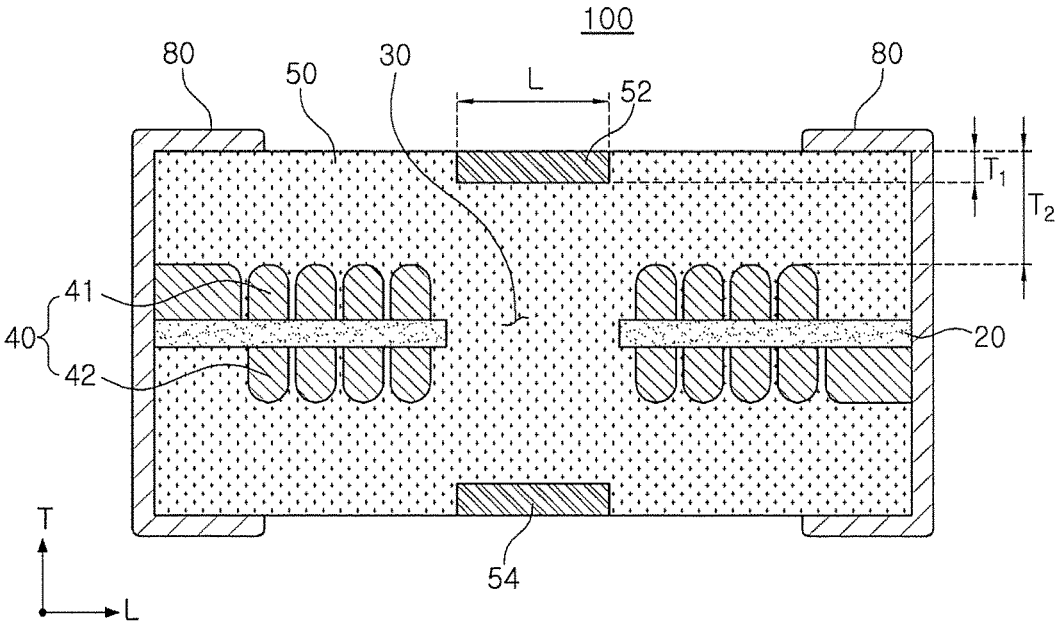
FIG. 2 is a cross-sectional view taken along line I-I' of FIG. 1.

FIG. 1 is a perspective view schematically illustrating a coil electronic component according to an exemplary embodiment in which a substrate and coil patterns are visible, and FIG. 2 is a cross-sectional view taken along line I-I' of FIG. 1. Referring to FIG. 1, as an example of the coil electronic component, a thin film-type inductor used in a power line of a power supply circuit is disclosed.

A coil electronic component 100 according to an exemplary embodiment may include a substrate 20, coil patterns 40 formed on at least one surface of the substrate 20, and a body 50 formed to fill at least core area 30 of the coil and containing a magnetic material.

In the coil electronic component 100 according to the exemplary embodiment, a 'length' direction refers to an 'L' direction of FIG. 1, a 'width' direction refers to a 'W' direction of FIG. 1, and a 'thickness' direction refers to a 'T' direction of FIG. 1.

The substrate 20 may be an insulating substrate 20 and may be, for example, a polypropylene glycol (PPG) substrate, a ferrite substrate, a metal-based soft magnetic substrate, or the like.

A central portion of the substrate 20 may be provided with a through hole. The through hole may be filled with a magnetic material to form the core area 30. The core area 30 filled with the magnetic material may improve inductance L of the thin film-type inductor.

Both surfaces of the substrate 20 may each be formed with spiral first coil 41 and second coil 42 which may be connected to each other through a via hole (not illustrated).

The first and second coil patterns 41 and 42 and the via hole (not illustrated) may be formed of metals having excellent electrical conductivity and may be formed of, for example, at least one of silver (Ag), palladium (Pd), aluminum (Al), nickel (Ni), titanium (Ti), gold (Au), copper (Cu), platinum (Pt), or alloys thereof. In this case, as an example of a process for manufacturing the coil 40, the first and second coil patterns 41 and 42 may be formed by electroplating. However, other processes known to the art may also be used so long as similar effects may be obtained through the use thereof.

The first and second coil patterns 41 and 42 may be coated with an insulating layer (not illustrated) not to directly contact the magnetic material forming the body 50.

The body 50 is an area defining an appearance of the coil electronic component 100 and a kind of magnetic materials forming the body is not particularly limited so long as they are materials representing magnetic characteristics. For example, the magnetic material may be ferrite or metal-based soft magnetic materials.

In more detail, the ferrite may be manganese (Mn)-zinc (Zn) based ferrite, nickel (Ni)-zinc (Zn) based ferrite, nickel (Ni)-zinc (Zn)-copper (Cu) based ferrite, manganese (Mn)-magnesium (Mg) based ferrite, barium (Ba) based ferrite, or lithium (Li) based ferrite and the metal-based soft magnetic material may be crystalline or amorphous metal including at least one selected from the group consisting of iron (Fe), silicon (Si), chromium (Cr), aluminum (Al), and nickel (Ni)

and may be, for example, Fe—Si—B—Cr based amorphous metal particles but is not limited thereto.

The magnetic material may be provided in particle form having an average diameter of 0.1 μm through 20 μm to be dispersed in thermosetting resins of epoxy resin, polyimide resin, or the like.

The coil electronic component 100 according to the exemplary embodiment further includes an external electrode 80 attached to at least one outer surface of the body 50 and electrically connected to the coil 40.

The coil electronic component 100 according to the exemplary embodiment may include magnetic flux controllers 52 and 54 formed to correspond to the core area 30 at the outer surface of the body 50, and the magnetic flux controllers 52 and 54 have a magnetic material with permittivity higher than that of the magnetic material included in the body 50. That is, the coil electronic component 100 may considerably reduce leakage of magnetic flux by making permittivity of an internal magnetic material different and may collect the magnetic flux by selectively forming the magnetic flux controllers 52 and 54 having high permittivity to only correspond to the core area 30 at the outer surface of the body 50 to suppress radiation noise from occurring, thereby considerably reducing malfunctioning of electronic components even when the amount of current provided to the electronic components increases.

According to the exemplary embodiment, the permittivity of the magnetic material included in the magnetic flux controllers 52 and 54 may be equal to or greater than 30 F/m. If the permittivity of the magnetic material included in the magnetic flux controllers 52 and 54 is below 30 F/m, the effect of the magnetic flux collection may be insufficient, such that the prevention of the malfunctioning of the electronic component set may be insufficient at the time of making a current for the electronic component set large.

According to the exemplary embodiment, the permittivity of the magnetic material included in the magnetic flux controllers 52 and 54 may be 1.5 times larger or more than that of the magnetic material included in the body 50. If a ratio of the permittivity of the magnetic material included in the magnetic flux controllers 52 and 54 and the permittivity of the magnetic material included in the body 50 is below 1.5 times, DC bias characteristics may deteriorate. The larger the value of the ratio of the permittivity of the magnetic material included in the magnetic flux controllers 52 and 54 and the permittivity of the magnetic material included in the body 50, the better the DC bias characteristics becomes. Therefore, an upper bound of the value is not particularly limited.

According to the exemplary embodiment, when a thickness of the magnetic flux controllers 25 and 54 is set to be $T_1$ and a minimum distance from the outer surface of the body 50, in which the magnetic flux controllers 25 and 54 are disposed, to the coil is set to be $T_2$, a ratio ($T_1/T_2$) of $T_1$ to $T_2$ may be equal to or less than ⅓. If the $T_1/T_2$ exceeds ⅓, the DC bias characteristics may deteriorate. The smaller the value of the $T_1/T_2$, the better the DC bias characteristics becomes. Therefore, a lower bound of the value is not particularly limited.

According to the exemplary embodiment, when viewing the coil electronic component from a side surface in the thickness-length direction thereof, a length of each of the magnetic flux controllers 52 and 54 may be shorter than that of the core area 30. If the length of each of the magnetic flux controllers 52 and 54 is equal to or greater than that of the core area 30, the DC bias characteristics may deteriorate. The smaller the value of the ratio of the length of the magnetic flux controllers 52 and 54 to the length of the core area 30, the better the DC bias characteristics becomes. Therefore, a lower bound of the value is not particularly limited. In addition, a width of each of the magnetic flux controllers 52 and 54 may be narrower than that of the core area 30.

Figure 3:
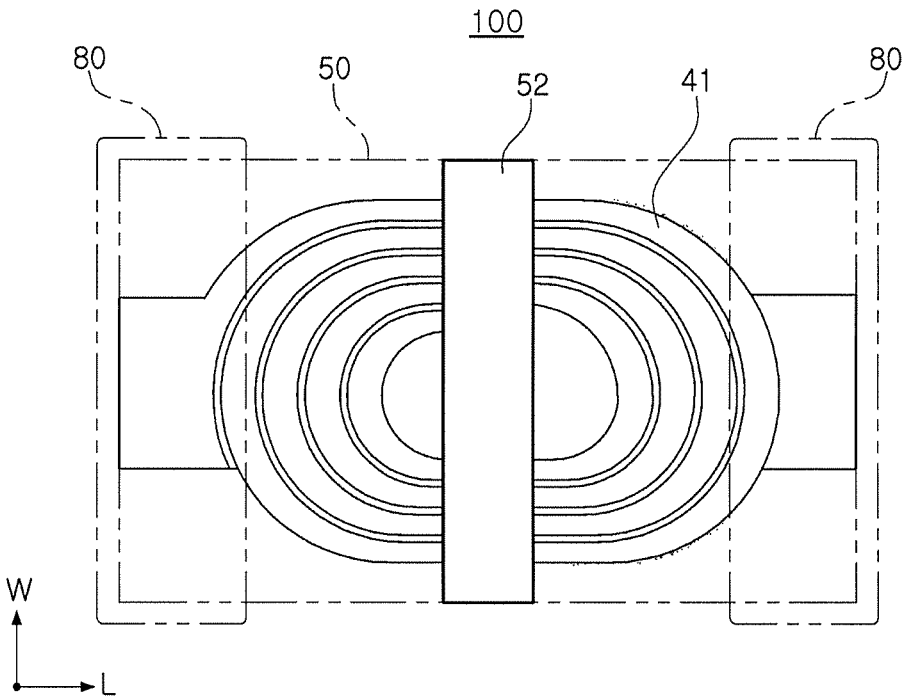
FIG. 3 is a plan view schematically illustrating a coil electronic component according to another exemplary embodiment in the present disclosure.

FIG. 3 is a plan view schematically illustrating a coil electronic component according to another exemplary embodiment.

Here, structures of a substrate, a coil pattern, and an external electrode are similar to those described above, and therefore, a detailed description thereof will be omitted to avoid the overlapping description.

Referring to FIG. 3, a magnetic flux controller according to another exemplary embodiment may extend in a width direction of the body 50. Although this may deteriorate DC bias characteristics, the magnetic flux controllers 52 and 54 may be manufactured by a simple process.

When viewing the coil electronic component 100 according to another exemplary embodiment from a top surface in the length-width direction, a length of each of the magnetic flux controllers 52 and 54 may be shorter than that of the core area 30, and a width of each of the magnetic flux controllers 52 and 54 may be greater than that of the core area 30.

Figure 4:
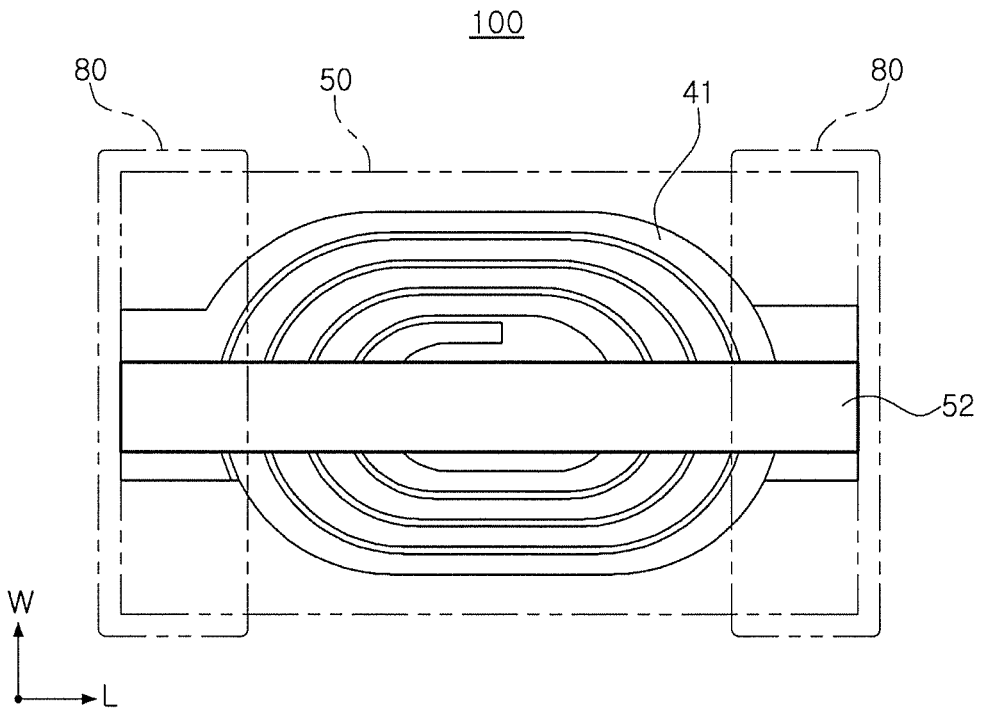
FIG. 4 is a plan view schematically illustrating a coil electronic component according to another exemplary embodiment in the present disclosure.

FIG. 4 is a plan view schematically illustrating a coil electronic component according to another exemplary embodiment.

Here, structures of a substrate, a coil pattern, and an external electrode are similar to those described above, and therefore, a detailed description thereof will be omitted to avoid the overlapping description.

Referring to FIG. 4, a magnetic flux controller according to another exemplary embodiment may extend in the length direction of the body 50. This may deteriorate the DC bias characteristics, but the magnetic flux controllers 52 and 54 may be manufactured by a simple process.

When viewing the coil electronic component 100 according to another exemplary embodiment from the top surface in the length-width direction thereof, each length L of the magnetic flux controllers 52 and 54 may be greater than that of the core area 30, and a width of each of the magnetic flux controllers 52 and 54 may be narrower than that of the core area 30.

As set forth above, according to the exemplary embodiments, the coil electronic component may considerably reduce the magnetic flux leaked externally and considerably reduce malfunctioning of an electronic component set even when setting a large amount of current for the electronic component.

Further, according to the exemplary embodiments, the coil electronic component may have excellent DC bias characteristics.

While exemplary embodiments have been shown and described above, it will be apparent to those skilled in the art that modifications and variations could be made without departing from the spirit and scope of the present disclosure as defined by the appended claims.

What is claimed is:

1. A coil electronic component, comprising:

a substrate;

a coil pattern disposed on at least one surface of the substrate;

a body filling at least a core area of the coil pattern and containing a magnetic material; and a magnetic flux controller disposed at an outer surface of the body and corresponding to the core area, the magnetic flux controller containing a magnetic material which has a permittivity value higher than that of the magnetic material of the body, wherein the magnetic flux controller has a surface area smaller than that of the core area such that the magnetic flux controller is disposed at the outer surface of the body partly, and wherein when viewing the coil electronic component from a side in a width-length direction thereof, a width of the magnetic flux controller is smaller than that of the core area.

2. The coil electronic component of claim 1, wherein the permittivity value of the magnetic material included in the magnetic flux controller is equal to or greater than 30 F/m.

3. The coil electronic component of claim 1, wherein the permittivity value of the magnetic material included in the magnetic flux controller is 1.5 times larger or more than that of the magnetic material included in the body.

4. The coil electronic component of claim 1, wherein when a thickness of the magnetic flux controller is $T_1$ and a minimum distance from the outer surface of the body, at which the magnetic flux controller is disposed, to a top surface of the coil pattern in a thickness direction of the coil electronic component is $T_z$, a ratio ($T_1/T_2$) of $T_1$ to $T_2$ is equal to or less than ⅓.

5. The coil electronic component of claim 1, wherein when viewing the coil electronic component from a side in a thickness-length direction thereof, a length of the magnetic flux controller is shorter than that of the core area.

6. The coil electronic component of claim 1, wherein the magnetic flux controller extends in a width direction of the coil electronic component from a center toward both sides of the body.

7. The coil electronic component of claim 6, wherein when viewing the coil electronic component in the width-length direction thereof, a length of the magnetic flux controller is shorter than that of the core area.

8. The coil electronic component of claim 1, wherein the magnetic flux controller extends in a length direction of the coil electronic component from a center toward both sides of the body.

9. The coil electronic component of claim 8, wherein when viewing the coil electronic component in the width-length direction thereof, a length of the magnetic flux controller is longer than that of the core area.

10. The coil electronic component of claim 1, further comprising:

external electrodes attached to side surfaces of the body and electrically connected to the coil pattern.

11. The coil electronic component of claim 1, wherein the coil pattern is formed in plural on both surfaces of the substrate, and the plural coil patterns are connected to each other by a via hole.

12. The coil electronic component of claim 1, wherein the magnetic materials are dispersed in a particle form in a thermosetting resin.

13. A coil electronic component, comprising:

a substrate;

at least one coil pattern disposed on upper and lower surfaces of the substrate;

a body filling a core area of the coil pattern and having a first magnetic material, the core area being in a center of the body;

external electrodes attached to side surfaces of the body and electrically connected to the coil patterns; and a second magnetic material grooved into the body at a center area of an outer surface of the body to correspond to the core area, the second magnetic material having a permittivity value 1.5 times or higher than that of the first magnetic material, wherein the magnetic flux controller has a surface area smaller than that of the core area, and wherein when viewing the coil electronic component from a side in a width-length direction thereof, a width of the center area, into which the second magnetic material is filled, is smaller than that of the core area.

14. The coil electronic component of claim 13, wherein the permittivity value of the second magnetic material is equal to or greater than 30 F/m.

15. The coil electronic component of claim 13, wherein a ratio of a thickness of the center area, into which the second magnetic material is filled, to a minimum distance from the outer surface of the body, at which the second magnetic material is grooved into the body, to a top surface of the coil pattern in a thickness direction of the coil electronic component is equal to or less than ⅓.

16. The coil electronic component of claim 13, wherein when viewing the coil electronic component from a side in a thickness-length direction thereof, a length of the center area, into which the second magnetic material is filled, is shorter than that of the core area.

17. The coil electronic component of claim 13, wherein when the second magnetic material extends in a width direction of the coil electronic component from a center toward both sides of the body, a length of the center area, into which the second magnetic material is filled, is shorter than that of the core area when viewing the coil electronic component in the width-length direction thereof.

18. The coil electronic component of claim 13, when the second magnetic material extends in a length direction of the coil electronic component from a center toward both sides of the body, a length of the center area, into which the second magnetic material is filled, is longer than that of the core area viewing the coil electronic component in the width-length direction thereof.

19. The coil electronic component of claim 13, wherein the first and second magnetic materials have a diameter of 0.1 μm to 20 μm and is dispersed in a particle form in a thermosetting resin.

20. The coil electronic component of claim 1, wherein the body includes a magnetic material and a resin.

* * * * *